US010329893B2

(12) United States Patent
Smith

(10) Patent No.: US 10,329,893 B2
(45) Date of Patent: Jun. 25, 2019

(54) ASSEMBLY AND METHOD FOR DYNAMIC, HEAVE-INDUCED LOAD MEASUREMENT

(71) Applicant: Frank's International, LLC, Houston, TX (US)

(72) Inventor: Logan Smith, Youngsville, LA (US)

(73) Assignee: FRANK'S INTERNATIONAL, LLC, Houston, TX (US)

( * ) Notice: Subject to any disclaimer, the term of this patent is extended or adjusted under 35 U.S.C. 154(b) by 0 days.

(21) Appl. No.: 15/072,523

(22) Filed: Mar. 17, 2016

(65) Prior Publication Data

US 2016/0273334 A1 Sep. 22, 2016

Related U.S. Application Data

(60) Provisional application No. 62/134,059, filed on Mar. 17, 2015.

(51) Int. Cl.
*E21B 47/00* (2012.01)
*E21B 19/10* (2006.01)

(52) U.S. Cl.
CPC ..... *E21B 47/0001* (2013.01); *E21B 19/10* (2013.01)

(58) Field of Classification Search
CPC ..... E21B 47/0001; E21B 19/10; E21B 44/00
USPC ..... 166/336
See application file for complete search history.

(56) References Cited

U.S. PATENT DOCUMENTS 4,858,694 A 8/1989 Johnson et al.
6,793,021 B1 9/2004 Fanguy
8,939,219 B2 1/2015 Taskinen et al.
2002/0059837 A1* 5/2002 Meyer ..... G01L 1/2231 73/862.042
2005/0000696 A1* 1/2005 McDaniel ..... E21B 19/004 166/379
2006/0124353 A1 6/2006 Juhasz et al.
2010/0101805 A1 4/2010 Angelle et al.
2011/0048737 A1* 3/2011 Schneider ..... E21B 19/10 166/380
2011/0259576 A1 10/2011 Mulder et al.
2011/0290499 A1* 12/2011 Petegem ..... B63B 25/28 166/350
2013/0255969 A1 10/2013 Olsen et al.
2015/0315855 A1 11/2015 Dewald et al.

FOREIGN PATENT DOCUMENTS

WO 2004/090279 A1 10/2004

OTHER PUBLICATIONS

Quigley et al., "Brief: Field Measurements of Cashing Tension Forces", JPT, Feb. 1995, pp. 127-128.*

(Continued)

*Primary Examiner* — Anna M Momper
*Assistant Examiner* — Patrick F Lambe
(74) *Attorney, Agent, or Firm* — MH2 Technology Law Group LLP

(57) ABSTRACT

A tubular support assembly, method, and offshore drilling rig. The tubular support assembly includes a spider configured to support a tubular received therethrough, and a rotary table that supports the spider and transmits a vertical load applied to the spider to a rig floor. The tubular support assembly also includes a load cell configured to measure the vertical load.

9 Claims, 3 Drawing Sheets

(56) References Cited

OTHER PUBLICATIONS

Jin Ho Kim (Authorized Officer), International Search Report and Written Opinion dated Jun. 10, 2016, International Application No. PCT/US2016/022763, filed Mar. 17, 2016, pp. 1-15.
Quigley et al., "Field Measurements of Casing Tension Forces", SPE 69th Annual Technial Conference and Exhibition, Sep. 25-28, 1994, SPE 28326, pp. 357-364.
Quigley et al., "Brief: Field Measurements of Casing Tension Forces", JPT, Feb. 1995, pp. 127-128.
Extended European Search Report dated Oct. 5, 2018, EP Application No. 16765713, filed Jun. 12, 2017, pp. 1-9.

* cited by examiner

ASSEMBLY AND METHOD FOR DYNAMIC, HEAVE-INDUCED LOAD MEASUREMENT

CROSS-REFERENCE TO RELATED APPLICATIONS

This application claims priority to U.S. Provisional Patent Application having Ser. No. 62/134,059, which was filed on Mar. 17, 2015, and is incorporated herein by reference in its entirety.

BACKGROUND

In offshore drilling applications, oilfield tubulars (e.g., casing, drill pipe, strings thereof, etc.) are run from a drilling rig located on a marine vessel or a platform, down to the ocean floor, and then into an earthen bore formed in the ocean floor. In the case of the drilling rig being provided as a buoyant, marine vessel, the position of the vessel is affected by waves on the surface of the ocean. This position change is generally referred to as "heave."

Rig vessels employ a variety of active and passive systems to limit heave; however, heaving movement of the vessel may still occur, for example, in rough seas. This may present a challenge, as the rig may support the oilfield tubular string deployed therefrom using a relatively rigid assembly, for example, including a spider, as compared to a hoisting assembly supporting the oilfield tubulars from flexible cables or compensating systems. Thus, when heaving movement of the rig occurs while the spider supports the oilfield tubular string, a force tending to move the upper end of the tubular string is applied thereto, while the inertia and/or other constraints applied to the position of the tubular string resist such movement. This represents a dynamic loading of the spider and/or the tubular string. Given the heavy weight of the tubular string and rig, such heave-induced dynamic loading may potentially reach dangerous levels.

What is needed are tubular support assemblies and methods for monitoring such dynamic loading so as to, for example, avoid damaging the rig structure or the tubular.

SUMMARY

Embodiments of the present disclosure may provide a tubular support assembly. The tubular support assembly includes a spider configured to support a tubular received therethrough, and a rotary table that supports the spider and transmits a vertical load applied to the spider to a rig floor. The tubular support assembly also includes a load cell configured to measure the vertical load.

Embodiments of the present disclosure may also provide a method for measuring dynamic load in an oilfield rig. The method includes coupling a load cell between at least two components of a tubular support assembly. The tubular support assembly includes a spider and a rotary table, with the rotary table being supported by a rig structure. The method also includes engaging a tubular using the spider. A vertical load is applied to the tubular support assembly when the spider engages the tubular, and a dynamic loading of the spider is experienced when the rig heaves. The method further includes measuring the dynamic loading using the load cell.

Embodiments of the disclosure may further provide an offshore drilling rig, which includes a floor through which a tubular is received and deployed into a well, a rotary adapter bushing through which the tubular is received, a spider received into the rotary bushing, the tubular being received through the spider, and the spider being configured to engage the tubular, to support a weight of the tubular, and a load cell positioned between the spider and the rig floor, the load cell being configured to determine a dynamic loading of the spider.

The foregoing summary is intended merely to introduce a subset of the features more fully described of the following detailed description. Accordingly, this summary should not be considered limiting.

BRIEF DESCRIPTION OF THE DRAWINGS

The accompanying drawing, which is incorporated in and constitutes a part of this specification, illustrates an embodiment of the present teachings and together with the description, serves to explain the principles of the present teachings. In the figures.

Figure 1:
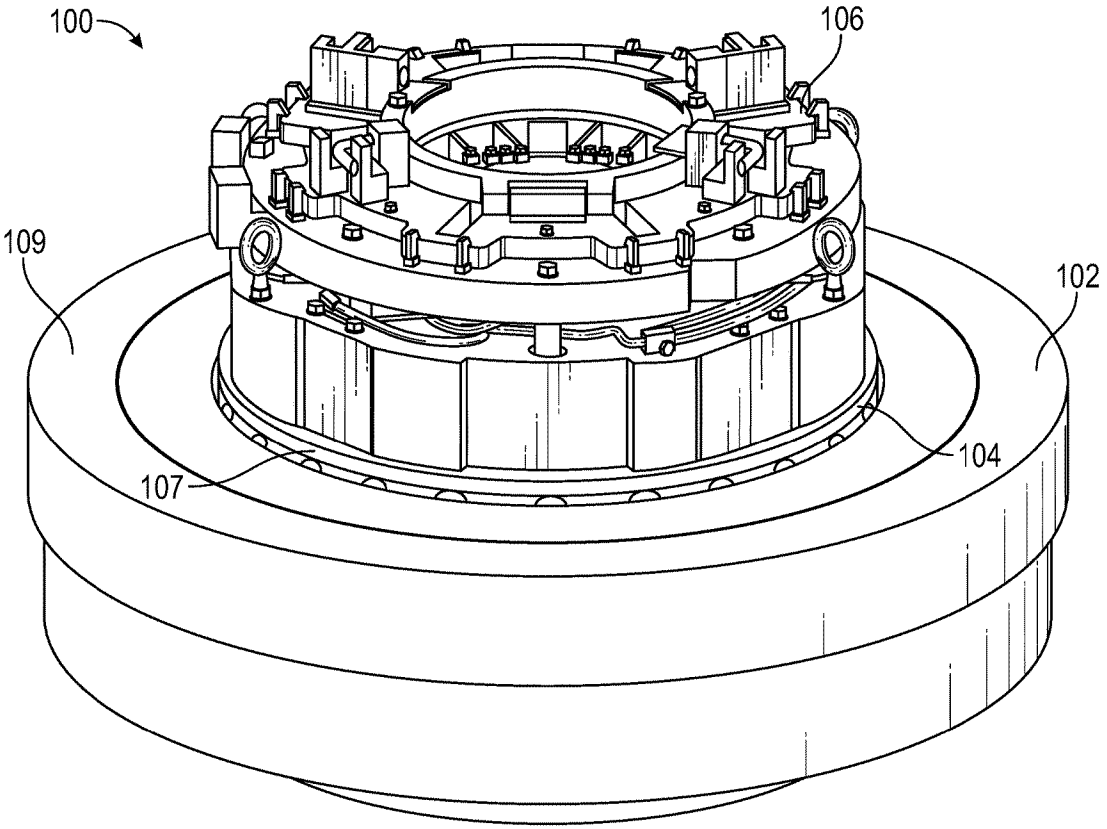
FIG. 1 illustrates a perspective view of a tubular support assembly, according to an embodiment.

It should be noted that some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, like reference numerals have been used throughout to designate identical elements, where convenient. In the following description, reference is made to the accompanying drawing that forms a part thereof, and in which is shown by way of illustration a specific exemplary embodiment in which the present teachings may be practiced. The following description is, therefore, merely exemplary.

In general, embodiments of the present disclosure may provide a tubular support assembly and a method for measuring a dynamic, vertical load applied by a string of tubulars supported by the assembly, for example, as induced by movement or "heave" of the drilling rig. In various examples, the tubular support system includes at least a spider and a rotary table, with the spider engaging the tubular and transmitting the weight of the tubular to the rotary table, which in turn is supported by the rig. As such, the tubular support system may have a relatively high rigidity, as compared to the hoisting systems from which tubulars are suspended while being lowered into the well.

To measure the loading of the spider, one or more load cells are provided in the tubular support system. For example, the load cell(s) may be disposed within the spider, so as to directly measure the force applied by the tubular onto the slips or bushing of the spider. In other examples, the load cell(s) may be disposed between the spider and the rotary table, e.g., between the spider and the rotary adaptor bushing. The load cell(s) may also or instead be positioned at any point between the rotary table and the rig floor, e.g., at the derrick mounts, so as to measure the loading of the spider via the loading of the derrick. In other embodiments, the load cell may be placed anywhere that vertical loading of the spider may be measured, e.g., between any two components through which the weight of the tubular is transmitted while the tubular is supported by the spider. In some cases, the load cells may be positioned closer to the tubular (i.e., with fewer components transmitting forces between the tubular and the load cell), as this may reduce a noise component of the signal produced by the weight of the components between the tubular and the load cell. However, in other cases, it may be easier or more reliable to place the load cells further way from the tubular.

Accordingly, the load cell may continuously (i.e., over time, whether analogue or at one or more sampling frequencies) measure the load on the spider, and thus on the rig and tubular string, as the tubular is supported in the tubular support assembly. Furthermore, the load data may be stored relative to the time domain over which the load measurements occurred. Storing load data according to a time domain allows the measured load data to be correlated to other data that may be similarly stored according to time domain, such as string raising/lowering dynamics, vessel heave, etc. Such continuous measurement may allow dynamic loading to be determined. For example, the load cell may produce signals, which may be interpreted by, for example, one or more processing components. The processing components may display, record, store, etc. the load thereon, e.g., specifically the dynamic loading amounts, which may provide useful data for rig design, operation, and/or the like. In a specific example, the dynamic loading history may be matched to a heave data history for the rig, and may facilitate determination of a load path for future loading and sea state conditions. The processing components may also be preset with alarm thresholds or the like, and may emit a warning when the dynamic loading is outside of the thresholds.

Turning now to the illustrated examples, FIG. 1 depicts a perspective view of a tubular support assembly 100, according to an embodiment. The assembly 100 generally includes a rotary adapter bushing 102, a load cell 104, and a spider 106. The spider 106 and the load cell 104 may be supported in the rotary adapter bushing 102. The rotary adapter bushing 102 may be supported by a rotary table (not shown in FIG. 1), which may be supported by the rig floor, derrick mounts, etc., so as to transmit force eventually to the ocean in which the rig is buoyant. As shown, the load cell 104 may be formed as a cylindrical element; however, in other embodiments, the load cell 104 may be any other shape. In this embodiment, although not visible in FIG. 1, the rotary adapter bushing 102 includes an annular shoulder on its inner diameter. The load cell 104 is seated on this shoulder, such that a loading surface 107 thereof extends vertically upward from a top surface 109 of the rotary adapter bushing 102. The spider 106, in turn, is seated on the loading surface 107 of the load cell 104, such that a vertical load applied to the spider 106 is transmitted to the rotary adapter bushing 102 via the load cell 104 and the shoulder.

An oilfield tubular (e.g., drill pipe, casing, stands thereof, strings thereof, etc.) may be lowered through the spider 106, e.g., using a conventional hoisting and/or drilling system (e.g., elevator, draw-works, top drive, etc.). Once the tubular reaches a desired location, slips or a bushing, or any other engaging features of the spider 106 may be drawn radially inwards, so as to grip and/or otherwise support the tubular towards an upper end thereof. Thereafter, a next tubular may be hoisted and connected ("made-up") to the tubular being supported by the spider 106. Once the hoisted tubular is fully connected to the tubular supported by the spider 106, the spider 106 may release the tubular, such that the tubular string weight is supported by the hoisting assembly of the rig, and then string may be lowered, potentially while being rotated, e.g., as part of drilling operations. Thereafter, the process of engaging the tubular with the spider 106 is repeated. Accordingly, the rotary adapter bushing 102 may be stationary with respect to the rig, e.g., may not be hoisted or otherwise suspended, such as by flexible cables, from the rig.

Figure 2:
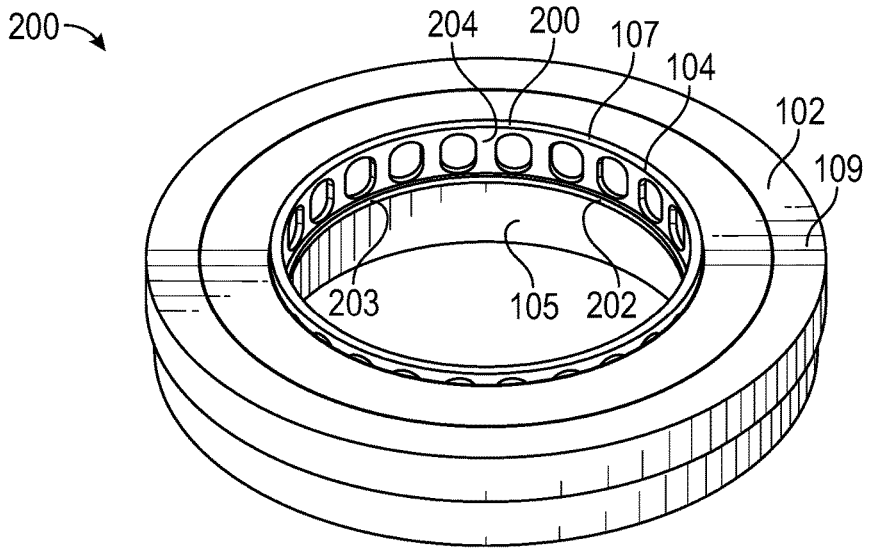
FIG. 2 illustrates a perspective view of the assembly with the spider thereof removed, according to an embodiment.

FIG. 2 illustrates a perspective view of the tubular support assembly 100, with the spider 106 omitted to facilitate further viewing of the load cell 104, according to an embodiment. The load cell 104 may include a first ring 200 and a second ring 202, which may be separated axially apart from one another. The first ring 200 may provide the loading surface 107, while the second ring 202 is seated on a shoulder 203 formed on the inner diameter 105 of the rotary adapter bushing 102, as mentioned above. Ribs 204 may extend between the first and second rings 200, 202. The load cell 104 may also include one or more strain gauges, which may provide an electrical signal that varies based on the distance between the first and second rings 200, 202. Accordingly, under a vertically compressive load on the load cell 104, e.g., as between the spider 106 (FIG. 1) and the rotary adapter bushing 102, the strain gauge may output a signal representative of the load. This may permit real-time, continuous monitoring of the load applied to the tubular string as it is supported by the spider 106.

Figure 3:
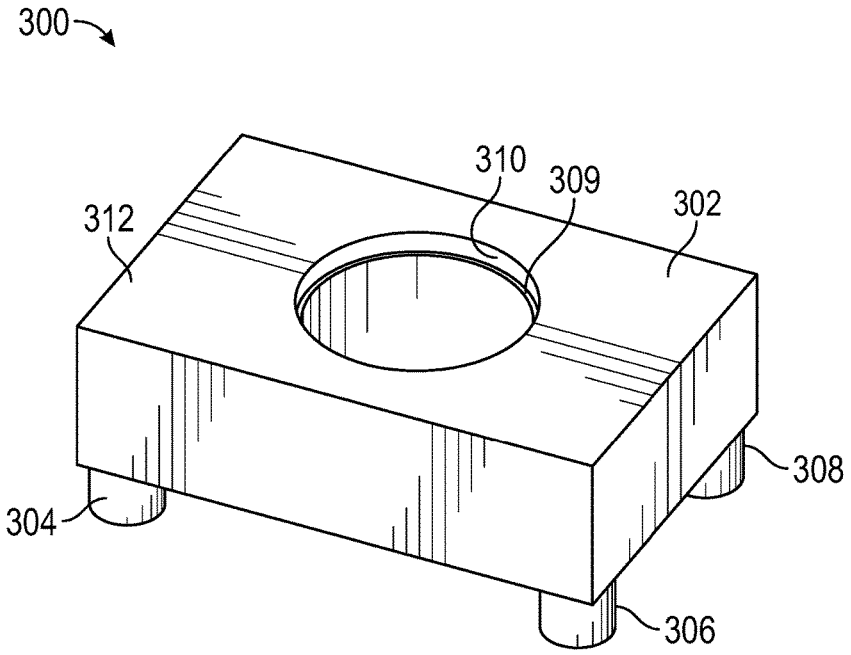
FIG. 3 illustrates a perspective view of another tubular support assembly, according to an embodiment.

FIG. 3 illustrates a perspective view of another tubular support assembly 300, according to an embodiment. In this embodiment, the tubular support assembly 300 includes a rotary table 302 and one or more load cells (three are visible: 304,306, 308), which may be located, for example, where the rotary table 302 meets the rig floor (not shown in FIG. 3). The load cells 304, 306, 308 may be provided by any suitable type of load cell. The rotary table 302 may include a shoulder 309 formed on an inner diameter 310 thereof. Although not shown, a spider, configured to support a tubular string received therethrough, may be received into the inner diameter 310 and supported vertically by engagement with the shoulder 309 and/or with a top surface 312 of the rotary table 302.

Accordingly, the load applied to the spider may be transmitted to the rotary table 302. In turn, the load applied to the rotary table 302 may be transmitted to the rig floor (not shown) via the load cells 304, 306, 308. Thus, similar to the tubular support assembly 100 described above, the tubular support assembly 300 may measure and provide a signal indicative of vertical load applied thereto by engagement between the spider and the oilfield tubular supported therein.

Figure 4:
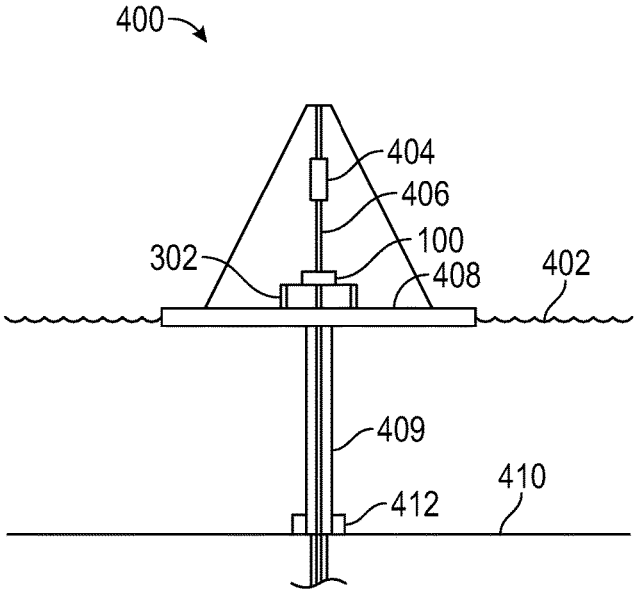
FIG. 4 illustrates a schematic view of a drilling rig, according to an embodiment.
Figure 5:
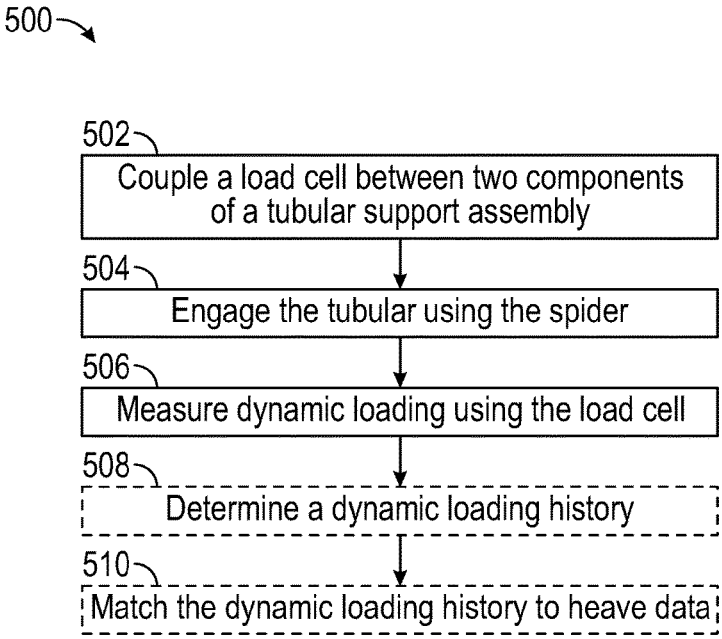
FIG. 5 illustrates a flowchart of a method for measuring a dynamic load, according to an embodiment.

FIG. 4 illustrates a schematic view of an offshore drilling rig 400, according to an embodiment. The rig 400 may be floating, as shown, on the surface 402 of a body of water, such as the ocean. In some embodiments, the rig 400 may be a marine vessel, i.e., a ship, but in other embodiments may be a platform that may be moved into position by a ship. The rig 400 may include hoisting and/or drilling equipment 404, which may be configured to lower a tubular 406 through a rig floor 408 of the rig 400.

The rig 400 may include the tubular support assembly 100, as illustrated, but may additionally or instead include the tubular support assembly 300, as described above, may include the rotary table 302 through which the tubular 406 is received. The rotary table 302 may be supported by the rig floor 408. Further, the tubular support assembly 100 may include the spider 106, the rotary adapter bushing 102, and/or the load cell 104, as shown in and described above with reference to FIGS. 1 and 2. Alternatively, as shown in FIG. 3, the load cells 304, 306, 308 may be positioned between the rotary table 302 and the rig floor 408.

The tubular 406 may be received through a riser 409 to the ocean floor 410. The tubular 406 may then be received through various subsea equipment 412, such as one or more blowout preventers.

With reference to FIGS. 1-4, FIG. 5 illustrates a flowchart of a method 500 for measuring dynamic load in an oilfield rig, according to an embodiment. For convenience, the method 500 is described with respect to the above-described embodiments of the tubular support assemblies 100, 300, but it will be appreciated that some embodiments of the method 500 may be executed using different structures.

The method 500 may include coupling a load cell between at least two components of a tubular support assembly 100, as at 502. In some embodiments, the tubular support assembly 100 includes the spider 106 and the rotary table 302, with the rotary table 302 being supported by a rig floor 408. Further, coupling the load cell 104 may include receiving the load cell 104 into an inner diameter of a rotary adapter bushing 102 coupled with the rotary table 302. In such an embodiment, the vertical load applied by the tubular 406 on the spider 106 is transmitted to the rotary adapter bushing 102 via the load cell 104. In another embodiment, several load cells 304, 306, 308 may be employed, and coupling the load cell includes positioning the load cell(s) 304, 306, 308 below the rotary table 302, such that the vertical load on the rotary table 302 compresses the load cell(s) 304, 306, 308.

The method 500 may also include engaging the tubular 406 using the spider 106, as at 504. A vertical load is applied to the tubular support assembly 100 when the spider 106 engages the tubular 406. Further, a dynamic loading of the spider 106 is experienced when the spider 106 engages the tubular 406, e.g., when the rig 400 heaves, e.g., in response to wave action on the surface 402 of the water.

The method 500 may thus further include measuring the dynamic loading using the load cell, as at 506. In an embodiment, measuring the dynamic loading may include continuously measuring the vertical load on the spider 106 when the tubular 406 is supported in the tubular support assembly 100. Further, the method 500 may include storing data representing the dynamic loading as a function of time.

The method 500 may also include determining a dynamic loading history based on the dynamic loading measured by the load cell, as at 508. The method 500 may then also include matching the dynamic loading history to a heave data history for the rig, as at 510.

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A tubular support assembly for a floating drilling rig, comprising:

a spider configured to support a vertical tubular string received therethrough, wherein the tubular string is configured to be positioned at least partially within a vertical sub-sea riser;

a rotary adapter bushing that supports the spider and transmits a vertical load applied to the spider to a floating drilling rig, wherein the rotary adapter bushing defines an inner bore through which the vertical tubular string is received, and wherein the inner bore defines a shoulder; and a load cell configured to measure and record a value for the vertical load, wherein the value for the vertical load includes a weight of the tubular string and a dynamic heave-induced load applied to the tubular string by a heave of the floating drilling rig, wherein the load cell comprises:

a first ring providing a loading surface, wherein the spider is seated on the loading surface;

a second ring separated axially apart from the first ring by a plurality of ribs, wherein the second ring is seated on the shoulder of the inner bore of the rotary adapter bushing, such that the load cell is positioned at least partially within the inner bore of the rotary adapter bushing, and wherein a distance between the first and second rings varies in response to the vertical load, which axially-compresses the load cell between the spider and the shoulder; and one or more strain gauges that provide a signal that varies based on the distance between the first and second rings.

2. The assembly of claim 1, further comprising a rotary table coupled with the rotary adapter bushing, wherein the rotary table is configured to support the rotary adapter bushing and the spider.

3. The assembly of claim 2, wherein the load cell is interposed between the rotary adapter bushing and the spider, such that the vertical load on the spider compresses the load cell.

4. The assembly of claim 1, wherein the load cell extends partially out of the inner bore, such that the loading surface of the first ring of the load cell is above an upper surface of the rotary adapter bushing.

5. A method for measuring dynamic tubular string weight on a floating oilfield drilling rig, comprising:

coupling a load cell between at least two components of a tubular support assembly, the tubular support assembly comprising a spider, a rotary adapter bushing, and a rotary table, wherein the rotary table is supported by a rig structure, wherein the load cell comprises:

a first ring providing a loading surface, wherein the spider is seated on the loading surface;

a second ring separated axially apart from the first ring by a plurality of ribs, wherein the second ring is seated on a shoulder of an inner bore of the rotary adapter bushing, such that the load cell is positioned at least partially within the inner bore of the rotary adapter bushing, and wherein a distance between the first and second rings varies in response to the vertical load, which axially-compresses the load cell between the spider and the shoulder; and one or more strain gauges that provide a signal that varies based on the distance between the first and second rings;

engaging and supporting a vertical tubular string using the spider, wherein the tubular string is configured to be positioned at least partially within a vertical sub-sea riser, and wherein a dynamic heave-induced vertical load is applied to the tubular support assembly while the spider is supporting the tubular string;

measuring a value of a vertical load on the spider using the load cell, wherein the measured value of the vertical load includes a combination of a weight of the tubular string and a dynamic, heave-induced load caused by heaving movement of the floating drilling rig while the spider engages the tubular string; and determining the dynamic, heave-induced load applied to the tubular string based in part on the measured load.

6. The method of claim 5, wherein coupling the load cell comprises positioning the load cell between the spider and a rotary adapter bushing coupled with the rotary table, wherein the vertical load applied by the tubular on the spider is transmitted to the rotary adapter bushing via the load cell.

7. The method of claim 5, further comprising:

determining a dynamic loading history based on the dynamic heave-induced load; and matching the dynamic loading history to a heave data history for the rig.

8. The method of claim 5, further comprising storing an output data from the load cell representing the dynamic loading as a function of time.

9. The method of claim 5, wherein measuring the load using the load cell comprises continuously measuring the load using the load cell.

* * * * *